United States Patent [19]

Binns

[11] 4,088,219

[45] May 9, 1978

[54] PASSENGER CONVEYORS

[75] Inventor: Keith Binns, Harmandsworth, England

[73] Assignee: Dunlop Limited, London, England

[21] Appl. No.: 696,283

[22] Filed: Jun. 15, 1976

[30] Foreign Application Priority Data

Jun. 24, 1975 United Kingdom ..... 26845/75

[51] Int. Cl.[2] ..... B66B 9/12

[52] U.S. Cl. ..... 198/323; 198/325; 198/856

[58] Field of Search ..... 198/322—325, 198/502, 856; 116/65, 70, 114 P, 114 PV, 98

[56] References Cited

U.S. PATENT DOCUMENTS

| | | | |
|---|---|---|---|
| 3,687,257 | 8/1972 | Johnson | 198/325 |

FOREIGN PATENT DOCUMENTS

| | | | |
|---|---|---|---|
| 2,108,025 | 5/1972 | France | 198/323 |
| 2,313,422 | 3/1973 | Germany | 198/322 |
| 374,169 | 2/1964 | Switzerland | 198/323 |

*Primary Examiner*—Evon C. Blunk
*Assistant Examiner*—Joseph E. Valenza
*Attorney, Agent, or Firm*—Stevens, Davis, Miller & Mosher

[57] ABSTRACT

A comb plate device for a passenger conveyor comprising a longitudinally extending mounting plate for mounting transversely of a conveyor, a comb plate pivotally mounted on the mounting plate about an axis parallel to the said mounting plate and fluid-sensing means to detect pivotal movement of the comb plate when in use on a conveyor.

27 Claims, 1 Drawing Figure

PASSENGER CONVEYORS

Figure 2:
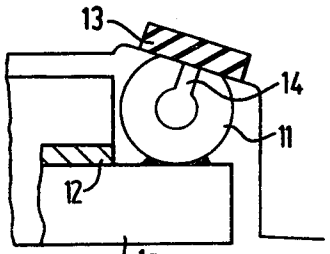

This invention relates to passenger conveyors and in particular to comb plate devices for sweeping the upper conveyor surface at the end of the load carrying zone. Conveyors may be of the continuous belt or metal pallet type.

Comb plate devices are known having associated safety cut-outs to stop the conveyor when the comb plate contacts a foreign body on the conveyor which may damage the conveyor or a person upon the conveyor. Satisfactory sensing requires a danger signal for a very small comb tip movement (of the order of 1–2 mm) and such sensitivity is difficult to obtain. Conventional systems utilize linkages to magnify the movement and operate a microswitch but such systems are somewhat bulky particularly with narrow modern balustrades and are difficult to arrange satisfactorily with wide comb plates.

According to the present invention a comb plate device for a passenger conveyor comprises a longitudinally extending mounting plate for mounting transversely of a conveyor, a comb plate pivotally mounted upon the mounting plate about an axis parallel to the said mounting plate and fluid sensing means to detect pivotal movement of the comb plate when in use on a conveyor.

The fluid sensing means may use air and the comb plate movement may be sensed by a flow detector in an air supply line or more preferably a pressure loss detector in the air supply line. Alternatively a vacuum or negative pressure detector may be used as the sensing means. The detectors may be remote from the comb plate device itself in which means for comb plate movement to cause air loss is provided. The means for causing air loss is preferably at least one aperture in the air system sealed by the comb plate when in normal operation and not sealed when the comb plate is pivoted by an obstruction on the conveyor. Several apertures may be provided at spaced apart intervals across the comb plate device. Furthermore the comb plate may be subdivided with at least one sensing aperture for each segment of comb plate so that fouling is effectively sensed for one segment of a comb plate even on a very wide comb. This allows small obstructions to operate the cut-out of a very wide conveyor as the obstruction only needs to lift a small segment of a very long and consequently heavy comb plate. The apertures may conveniently be formed in an air tube attached to the mounting plate beneath the comb plate.

The comb plate is preferably pivoted upon the mounting plate at the comb edge opposite to the edge for sweeping the conveyor surface and the means for causing air loss is provided intermediate the two said edges. Spring means may be provided to hold the comb plate in its normal position closing the air loss means although the weight of the comb itself may in some cases be sufficient without spring means.

Furthermore limited pivoted movement of the comb plate about the air tube may be provided so that an excessive load applied to the sweeping edge of the comb does not overstress the comb. It is also important that the comb when under load does not damage the tread surface.

The comb plate is preferably of the multi-pointed variety for use with a grooved conveyor surface. The points or teeth may be integral with the comb plate or comb plate segments or may be separate and detachable. The comb teeth may be rigid or flexible as is conventional in the art.

Figure 1:
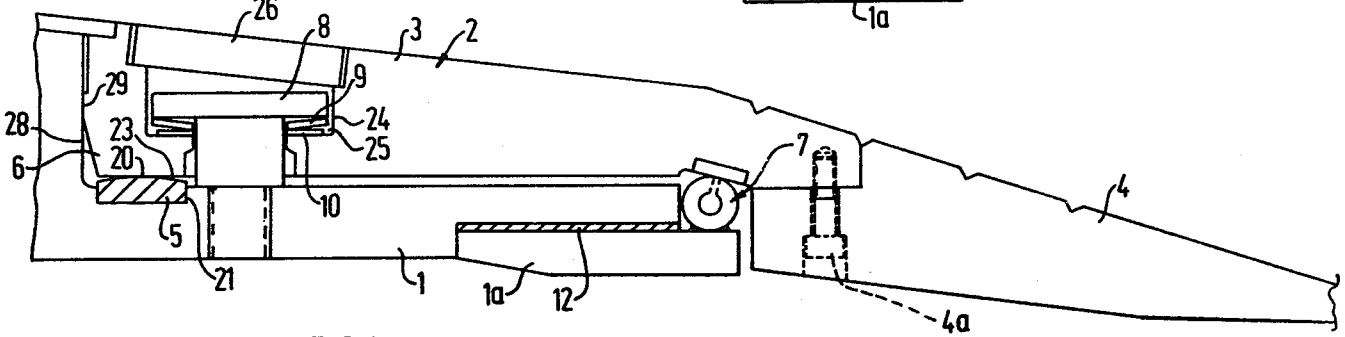

Further aspects of the invention will be apparent from the following embodiment described, by way of example only, in conjunction with the attached diagrammatic drawings in which FIG. 1 is a cross-section of a passenger conveyor comb plate device, and FIG. 2 is an enlarged view of the fluid sensing means circled in FIG. 1.

The comb plate device for a passenger conveyor comprises several segments of comb assemblies 2, and a mounting plate 1 in the form of a beam which can be mounted across the conveyor in the usual manner to allow the comb to sweep the conveyor surface. Each comb assembly 2 is pivotally attached to the mounting plate. Each comb assembly 2 comprises a comb plate body 3 having attached thereto two comb teeth portions 4, the portions 4 are attached to one edge by means of a countersunk cap-head bolt **4*a* and each portion carries twelve teeth which are arranged to engage grooves formed on the conveyor surface. The end 6 of the comb assembly 2 opposite comb teeth 4 is positioned with its underside 23 resting on a pivot bar 5 which comprises a bar with a curved upper surface 20 and which is mounted in a recess 21 in the mounting plate 1. Thus the comb assembly 2 may pivot about the pivot bar 5 when a lifting force is applied to the teeth 4**.

The end 6 of the comb assembly is provided with a narrow contact zone 29 which abuts an end face 28 provided on the mounting plate 1 to prevent horizontal movement of the comb plate relative to the mounting plate while still allowing the comb 2 to pivot.

The underside 23 of the comb assembly 2 also rests on a fluid sensing means 7 which abuts the assembly 2 approximately at the center when viewed as FIG. 1. The fluid sensing means 7 comprises a longitudinally extending member running parallel to the mounting plate 1 and extending fully across the comb device. Details of the sensing means 7 will be described below.

Each comb assembly 2 is retained upon the mounting plate 1 by means of two spaced apart headed studs 8 arranged adjacent to the pivot bar and arranged to screw into the mounting plate 1. Each headed stud 8 is countersunk into the comb body 3 and a clearance 25 is left between the head and the base of the countersink 24 so as to allow a predetermined degree of pivoting of the comb assembly 2 by allowing vertical displacement of the comb relative to the stud 8. An annular disc spring in the form of a washer 9 is fitted in said clearance 25 to rest on a hardened abutment washer 10 in order to preload the comb assembly downwardly onto the sensing means 7. The countersink 24 is packed with grease and sealed by a core plug 26.

The preload of the spring 9 is chosen such that a normal person standing on the comb teeth does not pivot the comb assembly but so that an excessive load on the teeth 4, which could damage the teeth, does cause such pivoting. The degree of rotation is limited by the clearance under the headed stud 8 and is arranged to be sufficient to reduce tooth damage under excessive loading. The head clearance is arranged in conjunction with the distance of the stud 8 from the pivot bar 5 so as to limit upward comblift to an acceptable amount.

The sensing means 7 (as shown in FIG. 2) comprises a thick walled steel tube 11 which is welded to plate **1*a* forming part of the mounting plate 1. The plate 1*a* is bolted to the mounting plate 1 and a spacing shim 12 is positioned between them. The thickness of the shim 12 is chosen so as to set the stop position of the sensing means 7 to provide the necessary running clearance between the comb teeth 4 and the conveyor surface. A series of spaced apart apertures 14 are provided in the wall of the tube 11 which extend upwardly towards the abutment of the comb assembly 2 on the sensing means 7. The apertures are arranged such that an aperture is associated with each segment of the comb. A rubber seal 13 is located in a hole in the comb assembly adjacent to each aperture 14 and arranged such that when the comb assembly 2 rests on the sensing means 7 the apertures 14 are sealed. One end of the tube 11 is sealed at the edge of the comb assembly 2 and a source of pressurised air is connected to the other end. The source of air is arranged such that only a limited volume of air is provided and a pressure switch is placed in the air line. Thus if any one of the apertures 14** is uncovered the pressure switch is operated.

The edge to edge assembly of comb segments provides a sensitive detector device each segment being capable of triggering the switch. Any number of segments may be provided each having a typical length of 50 cms and very wide conveyors may therefore by accommodated including in particular the wide boarding zones of some variable speed conveyor devices. The use of several segments allows the detection of an obstruction under part of the comb even when a passenger is standing on another part of the comb. The light weight of small segments allows efficient operation of the device irrespective of the overall comb length.

In an alternative arrangement the comb teeth 4 are integral with the comb body 3. Also the comb teeth may be resilient or resiliently mounted on the comb body 3. The tooth shape is also variable dependent on the groove shape in the conveyor surface. The device may also be used with a smooth conveyor surface by using a smooth edge on the comb assembly 2.

Alternative sensing means, including air flow detectors instead of pressure detectors, may be used. Furthermore other fluids may be used although air is preferred as air system technology is well developed and is able to cope with the environmental condition of a passenger conveyor installation. The use of air also has the advantage that the air current renders the installation self cleaning.

The use of a tube for the sensing means minimizes the required space under the comb and allows the detector to be positioned remotely from the conveyor. Furthermore one detector and air supply may be used for several combs depending on the conveyor installation.

Furthermore the use of small comb segments of lightweight removes the need for counterweights to give a sensitive comb device and thus the comb assembly is lighter and much less bulky than many previous designs.

Having now described my invention, what I claim is:

1. A comb plate device for stopping a passenger conveyor upon detection of potentially damaging condition on the conveyor comprising a longitudinally extending mounting plate for mounting transversely of a conveyor, a comb plate pivotally mounted on the mounting plate about an axis parallel to the said mounting plate and fluid-sensing means to detect pivotal movement of the comb plate away from the conveyor when in use on a conveyor said fluid-sensing means comprising a detector positioned in a vacuum line to detect opening of an aperture in the fluid-sensing means on pivotal movement of the comb plate.

2. A comb plate device according to claim 1 wherein the fluid-sensing means utilizes air and comb plate movement is sensed by a flow detector provided in an associated air supply line.

3. A comb plate device according to claim 1 wherein the vacuum line is secured to the mounting plate and said aperture co-operates with sealing means associated with the comb plate to seal the aperture when in normal operation, the aperture being unsealed when the comb plate is pivoted by an obstruction on the conveyor.

4. A comb plate device according to claim 3 wherein the sealing means comprises a resilient compressible seal secured to an adjacent surface of the comb plate and arranged to extend across the aperture to seal the aperture in normal operation.

5. A comb plate device according to claim 3 wherein the vacuum line is attached to the mounting plate beneath the comb plate to extend across the conveyor.

6. A comb plate device according to claim 1 wherein the comb plate is pivoted on a pivot bar secured to the mounting plate adjacent the comb edge opposite to the edge for sweeping the conveyor surface.

7. A comb plate device according to claim 1 wherein the comb plate is secured to the mounting plate by a bolt, clearance being provided between the bolt and the comb plate to allow the comb plate to pivot relative to the mounting plate.

8. A comb plate device according to claim 7 wherein spring means is provided to hold the comb plate against the fluid-sensing means and seal an aperture therein.

9. A comb plate device according to claim 8 wherein the spring comprises an annular spring disc positioned between the head of the bolt and the comb plate.

10. A comb plate device according to claim 6 wherein a portion of the comb edge opposite to the edge for sweeping the conveyor surface is arranged to abut an end face provided on the mounting plate the abutment of the comb plate and end face serving to provide limited pivotal movement so that an excessive load applied to the sweeping edge of the comb plate does not over-stress the comb plate.

11. A comb plate device according to claim 1 wherein the comb plate is sub-divided into a series of segments arranged side-by-side in edge-to-edge contact across the conveyor, each segment being associated with fluid sensing means.

12. A comb plate device according to claim 1 wherein the comb is of the multi-pointed variety for use with a grooved conveyor surface.

13. A comb plate according to claim 12 wherein the points or teeth are integral with the comb plate.

14. A comb plate device according to claim 12 wherein the points or teeth are separate from the comb plate.

15. A comb plate device for stopping a passenger conveyor upon detection of potentially damaging condition on the conveyor comprising a longitudinally extending mounting plate for mounting transversely of a conveyor, a comb plate pivotally mounted on the mounting plate about an axis parallel to the said mounting plate and fluid-sensing means to detect pivotal movement of the comb plate away from the conveyor when in use on a conveyor and a pressure loss detector in an associated air supply line to detect opening of an aperture in the fluid-sensing means on pivotal movement of the comb plate.

16. A comb plate device according to claim 15 wherein the air supply line is secured to the mounting plate and said aperture co-operates with sealing means associated with the comb plate to seal the aperture when in normal operation, the aperture being unsealed when the comb plate is pivoted by an obstruction on the conveyor.

17. A comb plate device according to claim 16 wherein the sealing means comprises a resilient compressible seal secured to an adjacent surface of the comb plate and arranged to extend across the aperture to seal the aperture in normal operation.

18. A comb plate device according to claim 16 wherein the air supply line is attached to the mounting plate beneath the comb plate to extend across the conveyor.

19. A comb plate device according to claim 15 wherein the comb plate is pivoted on a pivot bar secured to the mounting plate adjacent the comb edge opposite to the edge for sweeping the conveyor surface.

20. A comb plate device according to claim 15 wherein the comb plate is secured to the mounting plate by a bolt, clearance being provided between the bolt and the comb plate to allow the comb plate to pivot relative to the mounting plate.

21. A comb plate device according to claim 20 wherein spring means is provided to hold the comb plate against the fluid-sensing means and seal the aperture therein.

22. A comb plate device according to claim 21 wherein the spring comprises an annular spring disc positioned between the head of the bolt and the comb plate.

23. A comb plate device according to claim 19 wherein a portion of the comb edge opposite to the edge for sweeping the conveyor surface is arranged to abut an end face provided on the mounting plate the abutment of the comb plate and end face serving to provide limited pivoted movement so that an excessive load applied to the sweeping edge of the comb plate does not over-stress the comb plate.

24. A comb plate device according to claim 15 wherein the comb plate is sub-divided into a series of segments arranged side-by-side in edge-to-edge contact across the conveyor, each segment being associated with means to cause pressure loss.

25. A comb plate device according to claim 15 wherein the comb is of a multi-pointed variety for use with a grooved conveyor surface.

26. A comb plate device according to claim 25 wherein the points or teeth are integral with the comb plate.

27. A comb plate device according to claim 25 wherein the points or teeth are separate from the comb plate.

* * * * *